United States Patent [19]

Goans

[11] Patent Number: 4,852,394

[45] Date of Patent: Aug. 1, 1989

[54] ANTI-EXTRUSION SEALING MEANS

[75] Inventor: Kip B. Goans, Harvey, La.

[73] Assignee: Richard Lazes, Harvey, La.

[21] Appl. No.: 269,621

[22] Filed: Nov. 10, 1988

[51] Int. Cl.[4] ..... E21B 33/00

[52] U.S. Cl. ..... 73/49.8; 277/188 A

[58] Field of Search ..... 166/187; 277/188 A, 277/188 R, 194, 195, 198, 199; 73/40.5 R, 49.1, 49.5, 49.8, 46; 138/90, 89

[56] References Cited

U.S. PATENT DOCUMENTS

| | | | |
|---|---|---|---|
| 2,921,632 | 1/1960 | Clark, Jr. | 277/188 R |
| 3,559,733 | 2/1971 | Kilgore | 277/188 R |
| 4,452,463 | 6/1984 | Buckner | 277/188 A |

*Primary Examiner*—Hezron E. Williams

*Attorney, Agent, or Firm*—George A. Bode

[57] ABSTRACT

An anti-extruding packer for pressurizing under fluid pressure a segment of pipe or the connection between a segment of pipe and a coupling comprising: a cylindrical body member having a central bore and a reduced diameter portion at one of its ends, thereby defining an annular shoulder, a plurality of spaced apart protrusions depending from the annular shoulder, an annular groove provided in the annular shoulder and ring segments mounted on the annular shoulder and matingly engaging the protrusions for preventing the extrusion of the packer in the direction of the flow of the fluid under pressure.

4 Claims, 3 Drawing Sheets

ANTI-EXTRUSION SEALING MEANS

BACKGROUND OF THE INVENTION

1. Field of the Invention

The present invention relates to anti-extruding sealing means or packers for testing under fluid pressure a segment of pipe or the connection between a segment of pipe and a coupling. More particularly, the present invention relates to elastomer packers which in one application are employed inside a pipe to seal off a particular section of the pipe by using two of such devices spaced apart and filling the annular space created between them with a liquid or gas under high pressure in order to check the strength of the pipes outer wall or the coupling. Fluid is then injected into the packers so that they inflate and come into contact with the inside wall of the pipe so as to contain the test fluid on either side of the seal and thus test the integrity of pipe or the connection between the threads on the pipe and the threads of the coupling.

2. General Background

In the oil and gas production industry conduits or tubing sections of threaded pipe are joined end to end i.e. pin end to box end, to convey fluids. It is desirable that the joints be strong and that a tight fit exist and that the body wall be strong enough to withstand relatively high internal pressures. It is common practice in the industry to plug off the ends of each particular joint by screwing test plugs onto the respective threaded ends and to fill the inside of the pipe with a fluid under high pressure to check for leaks behind the collar. Evidence of any leaks when pressured up to standardized test pressure is an indication that either the external threads on the pin end or the internal threads on the coupling were improperly machined and thus not mating properly, or that they may not have been screwed together with adequate torque, or that the body wall is of insufficient strength to withstand the pressure. This test procedure is followed to simulate "down hole" conditions when there is pressure exerted on the connection.

This procedure was very inefficient due to the need to fill up the entire inside of the full length of the tubing with fluid until the introduction of the "Hydro Pressure Thread Tester" disclosed in U.S. Pat. No. 4,733,554, issued to Richard Lazes, by requiring only small volume high pressure pumps and only small quantities of test fluid. However, even after Lazes '554, one further problem which remained after inflation of the packer was its tendency to extrude or migrate along the pipe in the direction of flow of the test fluid introduced through the orifice in the mandrel thus causing it to become stuck in the pipe and damage seals.

The apparatus of the present invention provides anti-extrusion segments or rings mounted on the packer which expand when the packer is inflated and are there by forced into contact with the pipe being tested to prevent extrusion therealong. These anti-extrusion segments or ring sections will also work on conventional packers when the geometry of the packers permit adequate seal material to be present beneath the anti-extrusion means. With the apparatus of the present invention the ring sections expand and bind against the inside diameter of the pipe so that the packer does not extrude or migrate down the pipe in the direction of the flow of the test fluid.

SUMMARY OF THE PRESENT INVENTION

The preferred embodiment of the apparatus of the present invention solves the aforementioned problems in a straight forward and simple manner. What is provided is an elastomer seal energized by inflating with a test fluid until contact with the Inner Diameter (I.D.) of the pipe wall is maintained so as to contain the fluid on either side of the seal. The seal is backed by a cylindrical metal retainer or collar which has an Outer Diameter (O.D.) slightly smaller than the I.D. of the pipe. When the gap between the O.D. of the collar and I.D. of the pipe is too large, the seal will tend to grow or migrate or extrude into the this gap and damage will be done to the seal or cause the tool to be "stuck" in the pipe. Increased pressure on the seal or the time period during which it is energized aggravates this problem. The anti-extrusion ring segments are provided as a series of interlocking metal segments which expand radially from the collar and prevent the seal or packer from extruding down the pipe in the direction of flow of the test fluid.

Thus, it is an object of the present invention to be able to test at higher pressures and for longer times than with conventional packers.

It is a further object of the present invention to provide longevity of sealing means by reducing the wear on the seals through elimination of migration or extrusion.

It is a further object of the present invention to provide safer testing of the connection between segments of pipes and couplings by preventing the extrusion or migration of the packing means down the pipe in the direction of test fluid flow.

BRIEF DESCRIPTION OF THE DRAWINGS

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
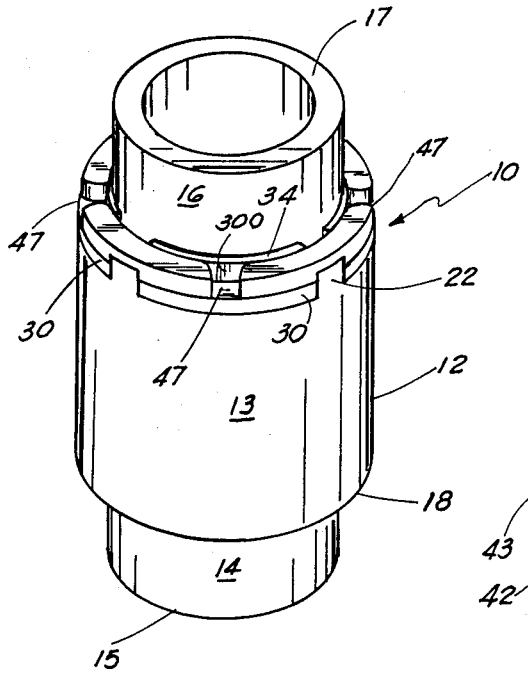
FIG. 1 is a top perspective view of the preferred embodiment of the apparatus of the present invention.
Figure 7:
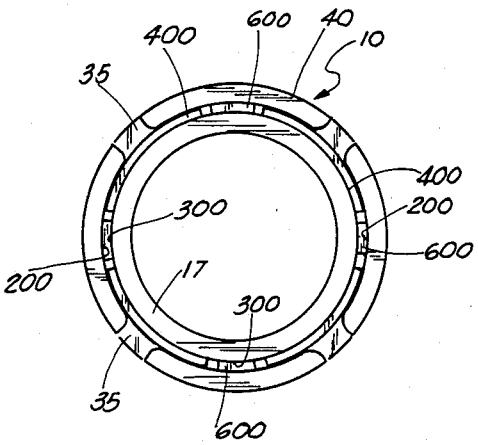
Figure 2:
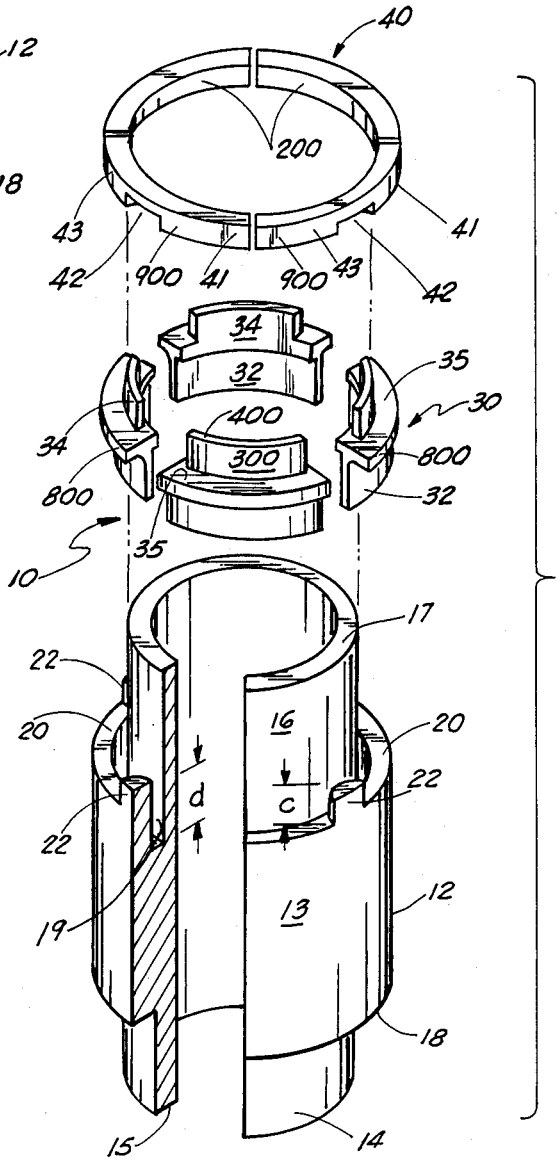
FIG. 2 is an exploded perspective view, partially in section, of the embodiment of FIG. 1.

Referring now to the drawings, and in particular FIGS. 1, 2 and 7, the apparatus of the present invention is designated generally by the numeral 10. Anti-extruding sealing means or packer 10 comprises a cylindrical body portion 12 having a main body portion 13 and end portions 14, 16 of a lesser diameter than portion 13, thus defining annular shoulder members 18, 20 respectively. Cylindrical body member 12 is formed preferably of a polyurethane or elastomer material and cylindrical body portions 14, 16 are of approximately the same diameter (although in an alternate embodiment only one of body portions 14, 16 is provided). One of the annular shoulder portions, in the preferred embodiment annular shoulder portion 20, has provided therein an annular groove 19 of a pre-selected depth "d," best seen in FIG. 2. The pre-selected depth "d" will become more apparent hereinafter. Annular groove 19 is provided in annular shoulder 20 on its innermost portion so that the groove 19 is defined by the outer wall of reduced diameter portion 16 and the innerwall of annular shoulder 20. Annular shoulder portion 20, in the preferred embodiment, has further provided therein a plurality of circumferentially spaced apart protrusions 22 which extend integrally from the surface of annular shoulder 20 toward annular surface 17 provided at the extremity of reduced diameter portion 16 (in an alternate embodiment groove 19 and protrusions 22 could be provided on annular shoulder 18 formed by reduced diameter portion 14 having its respective shoulder extremity 15). In the preferred embodiment, protrusions 22 extend upwardly from shoulders 20 a distance "c" approximately equal to the depth "d" of groove 19.

Figure 3:
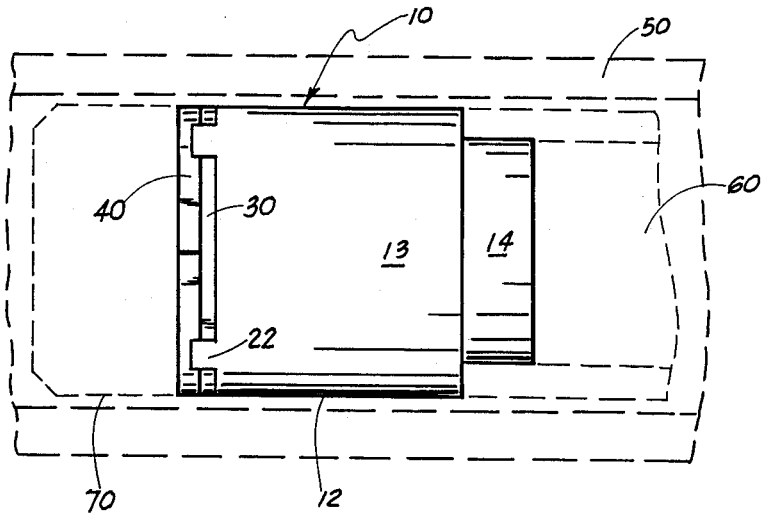
FIG. 3 is a side elevational view of the embodiment of FIG. 1 showing the apparatus inserted inside a "made up" connection as would be used to test that connection, this FIGURE showing the apparatus in its "inactive" position.

As best seen in FIGS. 1, 2 and 3, a plurality of first anti-extrusion ring segments 30 (of a length only slightly less than depth "d" of groove 19) are mounted on annular shoulder 20. Downwardly depending projections 32 of ring segments 30 are adapted to snugly mount in groove 19 so that ring segments 30 occupy the position best shown in FIG. 1. With ring segments 30 mounted on annular shoulder 20 and in groove 19 and spaced apart by protrusions 22, upwardly depending projections 34 thereof snugly abut the outer wall of reduced diameter portion 16.

With ring segments 30 now in place a second set of anti-extrusion ring segments 40 are positioned, as illustrated in FIG. 1, so that the under surfaces of end portions 41, 43 are resting on the upper surfaces 35 of corresponding adjacent lower ring segments 30. Further, notch 42 of each upper ring segment 40 mates with one of projections 22 integrally formed on annular surface 20 and between adjacent ring segments 30. In this orientation, slight gaps 47 exist between adjacent ring segments 40. In this way, as best seen in FIGURES 1, 3 and 7, first and second anti-extrusion ring segments 30, 40 overlap each other and form a metallic or metal-to-metal "seal" (or barrier, as no true sealing against fluid flow takes place) on one annular shoulder (shoulder 20 in the preferred embodiment) of apparatus 10.

Figure 4:
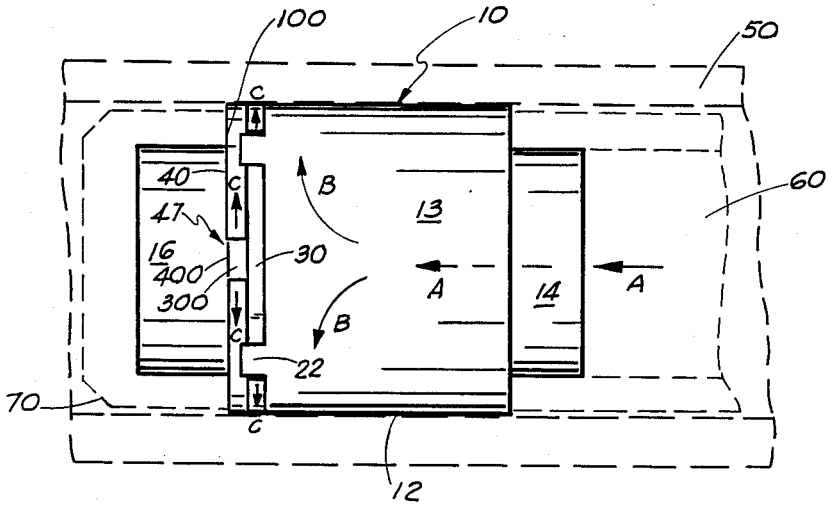
FIG. 4 is a side elevational view of the embodiment of FIG. 1 showing the apparatus inserted inside a "made up" configuration in the active and "testing" position.
Figure 5:
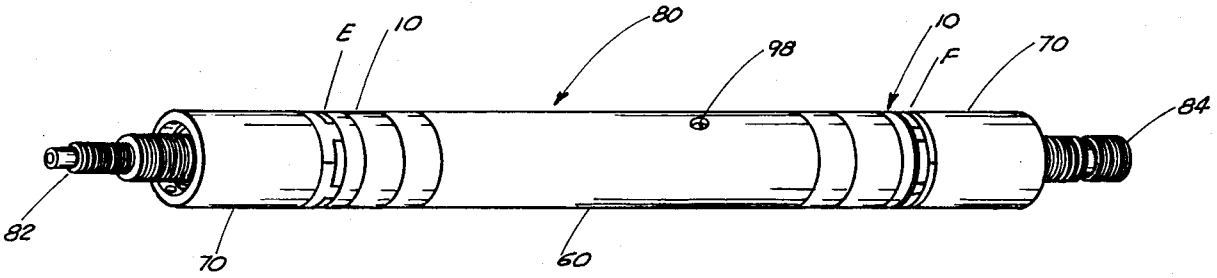
FIG. 5 is a perspective view of the embodiment of FIG. 1 showing the apparatus in a "made up" configuration on a conventional testing tool.
Figure 6:
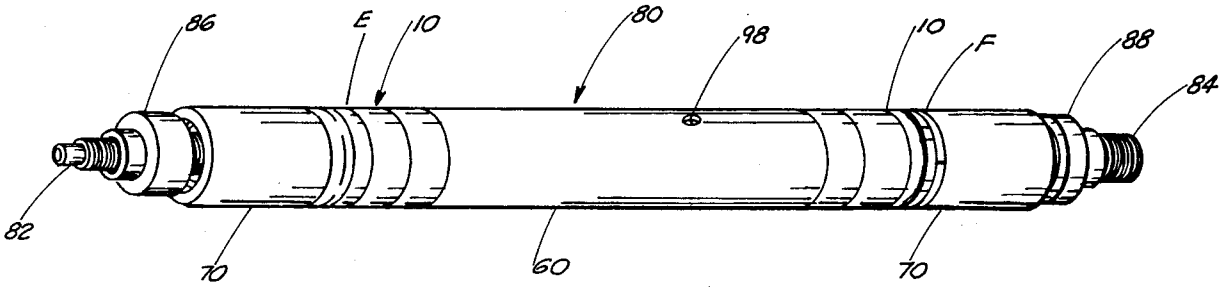
FIG. 6 is a view of FIG. 5 showing various parts of the "made up" configuration on a conventional testing tool; and, FIG. 7 is a top view of the apparatus of FIG. 1.

As best seen in FIGS. 3–6, apparatus 10 is in a "made up" configuration 80 as would be used to test a configuration of pipe or the connection between a segment of pipe and a coupling. As seen in FIGS. 5 and 6 apparatus 10 is placed on both ends of a mandrel 60 and secured thereto by retaining member or collar 70 (collar 70, as apparatus 10, having an outside diameter (O.D.) slightly less than the inside diameter (I.D.) of tubing 50) which is further retained on the test apparatus 80 by threaded members 86, 88 threadably secured to threaded ends 82, 84. With the test member 80 "made up" as illustrated in FIGS. 5 and 6, test fluid is introduced into mandrel 60 and the flow pattern develops as best illustrated in FIG. 4. Test fluid flows in the direction of ARROWS A through the bore of cylindrical member 12. Since cylindrical member 12 is of an elastomer or polyurethane material provided in metallic conduit or pipe or tubing 50, the member 12 will expand in the direction of fluid flow ARROWS B until cylindrical body member 12's outside diameter engages the wall of pipe or tubing 50 being tested. With the expansion of packer or cylindrical body portion 13, anti-extrusion ring segments 30, 40 move radially outwardly or in the direction of ARROWS C in FIG. 4 (this is possible due to the spacing of segments 30 by protrusions 22 (or gaps in an alternate embodiment) and the spacing of segments 40 by gaps 47) until their circumferential edges 800, 900 engage the inner diameter (I.D.) of conduit or tubing or pipe 50 being tested. The simultaneous engagement of the anti-extrusion segments 30, 40 with annular shoulder 100 of collar 70 prevents apparatus 10 from moving down pipe 50 in the direction of test fluid flow (ARROWS A). Without anti-extrusion ring segments 30, 40, packer 10 would migrate or extrude down pipe 50 in the direction of test fluid flow (ARROWS A) because the outer diameter (O.D.) of collar 70 of test apparatus 80 is less than the inner diameter (I.D.) of pipe 50. To prevent extrusion of the end portion of reduced diameter portion 16 in a radial direction through gaps 47, projections 34 of segments 30 are positioned directly under gaps 47. As best seen in FIG. 4, the surface 400 contacts shoulder 100 of collar 70 and maintains sliding contact with the packer 10 in an energized or de-energized state. As best seen in FIG. 7, surfaces 300 of segments 30 maintain sliding contact with surfaces 200 of segments 40 while packer 10 is in the energized or de-energized state. This sliding engagement prevents any elastomer flow from gap 600 that exists between protrusions 34. Not only do anti-extrusion ring segments 30, 40 prevent the migration or extrusion of apparatus 10 down pipe 50 in the direction of ARROWS A, but as they expand, as best illustrated in FIG. 4, they continue to cover or overlap each other to seal (although not an air-tight seal) off the test section of pipe between first set of rings 30, 40 at E and second set of rings 30, 40 at F of FIG. 5, segment of pipe 50 between E–F being the pipe segment which is being tested.

It can be clearly noted that only one set of protrusions 22 and anti-extrusion ring segments 30, 40 are provided on apparatus 10, although the same construction could be provided at both end portions 14, 16. This is because in testing, as illustrated in FIGS. 4–6, test fluid is introduced through orifice 98 and flows in the direction of ARROW A relative to apparatus 10 at point E and in the direction of ARROWS A relative to apparatus 10 at point F and the anti-extruding function only needs to be provided in that flow direction and not in the direction opposite flow; in other words apparatus 10 at location E of FIG. 5 does not need to be prevented from extruding in the direction opposite ARROW A as the test fluid flow is in the opposite direction and the only extrusion that will potentially occur is in the direction of ARROW A.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In an apparatus for pressurizing under fluid pressure a segment of conduit, anti-extrusion means comprising:

(a) a cylindrical body member having a central longitudinal bore therethrough and further having a reduced diameter portion at one of its ends, thereby defining an annular shoulders (b) means mounted on said annular shoulder for preventing extrusion of said anti-extrusion means, said means comprising:

i. a plurality of arcuately shaped first ring segments having upwardly and downwardly depending annular projections, said downwardly depending projections adapted to be mounted on said annular shoulder and said upwardly depending projections adapted to abut a portion of the circumference of said reduced diameter portion of said body member; and, ii. a plurality of arcuately shaped second ring segments adapted to be mated on said first ring segments and having means provided on the undersides thereof for matingly engaging said protrusions.

2. In an apparatus for pressurizing under fluid pressure a segment of conduit, anti-extrusion means comprising:

(a) a cylindrical body member having a central longitudinal bore therethrough and further having a reduced diameter portion at one of its ends, thereby defining an annular shoulder;

(b) a plurality of protrusions depending from said annular shoulder;

(c) an annular groove provided in said annular shoulder; and, (d) means mounted on said annular shoulder and matingly engaging said groove and said protrusions for preventing extrusion of said anti-extrusion means, said means comprising:

i. a plurality of first ring segments having first and second annular projections, said first projections adapted to be mounted in said annular groove and said second projections adapted to abut a portion of the circumference of said reduced diameter portion of said body member; and, ii. a plurality of second ring segments adapted to be mated on said first ring segments and having means provided on the undersides thereof for matingly engaging said protrusions.

3. In an apparatus for pressurizing under fluid pressure a segment of conduit, anti-extrusion means comprising:

(a) a cylindrical body member having a central longitudinal bore therethrough and further having a reduced diameter portion at one of its ends, thereby defining an annular shoulder;

(b) a plurality of spaced apart protrusions depending from said annular shoulder;

(c) an annular groove provided in said annular shoulder; and, (d) means mounted on said annular shoulder and matingly engaging said groove and protrusions for preventing extrusion of said anti-extrusion means, said means comprising:

i. a plurality of first ring segments having upwardly and downwardly depending annular projections, said downwardly depending projections adapted to be mounted in said annular groove and said upwardly depending projections adapted to abut a portion of the circumference of said reduced diameter portion of said body member; and, ii. a plurality of second ring segments adapted to be mated on said first ring segments and having means provided on the undersides thereof for matingly engaging said protrusions.

4. In an apparatus for pressurizing under fluid pressure a segment of conduit, anti-extrusion means comprising:

(a) a cylindrical body member of an elastomer material having a central longitudinal bore therethrough and further having a reduced diameter portion at one of its ends, thereby defining an annular shoulder;

(b) a plurality of integrally formed spaced apart protrusions depending longitudinally from said annular shoulder;

(c) an annular groove provided in said annular shoulder; and, (d) means mounted on said annular shoulder and matingly engaging said annular groove and protrusions for preventing extrusion of said anti-extrusion means, said means comprising:

i. a plurality of metallic first ring segments having upwardly and downwardly depending annular projections, said downwardly depending projections adapted to be mounted in said annular groove and said upwardly depending projections adapted to abut a portion of the circumference of said reduced diameter portion of said body member; and, ii. a plurality of second metallic ring segments adapted to be mounted on said first ring segments and having means on the undersides thereof for matingly engaging said protrusions.

* * * * *